US009488933B2

(12) United States Patent
Sawada et al.

(10) Patent No.: US 9,488,933 B2
(45) Date of Patent: Nov. 8, 2016

(54) SHEET CONVEYING DEVICE AND IMAGE FORMING APPARATUS

(71) Applicant: Konica Minolta Inc., Tokyo (JP)

(72) Inventors: Kenji Sawada, Toyokawa (JP); Sho Karakama, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/718,707

(22) Filed: May 21, 2015

(65) Prior Publication Data

US 2015/0338786 A1 Nov. 26, 2015

(30) Foreign Application Priority Data

May 26, 2014 (JP) ..... 2014-108475

(51) Int. Cl.

| | |
|---|---|
| ***G03G 15/00*** | (2006.01) |
| ***B65H 85/00*** | (2006.01) |
| ***B65H 5/36*** | (2006.01) |
| ***G03G 15/16*** | (2006.01) |
| ***B65H 5/26*** | (2006.01) |
| ***B65H 5/06*** | (2006.01) |
| ***G03G 15/23*** | (2006.01) |

(52) U.S. Cl.

CPC ..... *G03G 15/161* (2013.01); *B65H 5/062* (2013.01); *B65H 5/068* (2013.01); *B65H 5/26* (2013.01); *G03G 15/234* (2013.01); *G03G 2215/0043* (2013.01); *G03G 2215/00586* (2013.01); *G03G 2215/0132* (2013.01)

(58) Field of Classification Search

CPC .... G03G 15/00; G03G 21/00; G03G 15/161; G03G 15/234; G03G 2215/0043; G03G 2215/00586; G03G 2215/0132; B65H 85/00; B65H 5/26; B65H 5/062; B65H 5/068

See application file for complete search history.

(56) References Cited

U.S. PATENT DOCUMENTS

| | | | | | |
|---|---|---|---|---|---|
| 5,974,283 | A * | 10/1999 | Cho | B65H 15/00 | 271/301 |
| 8,989,651 | B2 * | 3/2015 | Mori | G03G 15/6573 | 399/401 |
| 2012/0082496 | A1 * | 4/2012 | Ozawa | G03G 15/6552 | 399/405 |
| 2013/0049285 | A1 * | 2/2013 | Reidhaar | B65H 85/00 | 271/3.19 |
| 2014/0035223 | A1 * | 2/2014 | Kato | B65H 85/00 | 271/225 |
| 2014/0153994 | A1 * | 6/2014 | Kubota | B41J 11/42 | 400/621 |

FOREIGN PATENT DOCUMENTS

| | | | | |
|---|---|---|---|---|
| JP | 54147842 | A * | 11/1979 | G03G 15/00 |
| JP | 05270713 | A * | 10/1993 | B65H 5/36 |
| JP | 07277577 | A * | 10/1995 | G03G 15/00 |
| JP | 09323854 | A * | 12/1997 | G03G 15/00 |
| JP | 2005200183 | A * | 7/2005 | B65H 5/36 |
| JP | 2008120543 | A | 5/2008 | |
| JP | 2011019223 | A * | 1/2011 | G03G 15/00 |
| JP | 2011253011 | A * | 12/2011 | G03G 15/00 |
| JP | 2012180176 | A | 9/2012 | |

OTHER PUBLICATIONS

Notice of Reasons for Rejection; Application No. 2014-108475; Dispatch Date: Mar. 10, 2016; Drafting Date: Mar. 2, 2016; Applied Provisions: Article 29 (1), 29 (2); total of 2 pages; English translation of Notice of Reasons for Rejection; total of 4 pages; Grand Total of 6 pages.

* cited by examiner

*Primary Examiner* — Nguyen Ha
(74) *Attorney, Agent, or Firm* — Lucas & Mercanti, LLP

(57) ABSTRACT

A sheet conveying device includes: a curved conveyance path; and a pair of downstream side rollers that lies on the downstream side with respect to the curved conveyance path, and catches the sheet conveyed from the upstream side with respect to the curved conveyance path and reaching the curved conveyance path, wherein the curved conveyance path includes a movable guide movable between a first position and a second position, at the first position, the movable guide forms an outer circumferential wall of the curved conveyance path, and guides a tip of the sheet in such a direction that the sheet conveyed to the curved conveyance path travels toward the pair of downstream side rollers, and at the second position, a summit portion of a curve of the outer circumferential wall is retracted toward the outside in a radial direction of the curve with respect to the first position.

10 Claims, 8 Drawing Sheets

SHEET CONVEYING DEVICE AND IMAGE FORMING APPARATUS

The entire disclosure of Japanese Patent Application No. 2014-108475 filed on May 26, 2014 including description, claims, drawings, and abstract are incorporated herein by reference in its entirety.

BACKGROUND OF THE INVENTION

1. Field of the Invention

The present invention relates to a sheet conveying device for conveying sheet, and an image forming apparatus including this sheet conveying device.

2. Description of the Related Art

An image forming apparatus spreading in recent years fixes a toner image to sheet, conveys the sheet to a curved conveyance path, and discharges the sheet by using a pair of discharge rollers disposed on the downstream side of the conveyance path. This type of image forming apparatus conveys the sheet in the vertical direction after transfer of the toner image to the sheet to fix the toner image, and then conveys the sheet in the horizontal direction to discharge the sheet, for example.

According to the image forming apparatus having this structure, the sheet conveyed to the curved conveyance path contacts an outer circumferential wall of a curved portion of the conveyance path, and travels toward the pair of discharge rollers while guided by the curved conveyance path. A sheet conveying device disclosed in JP 2008-120543 A is configured to withdraw a guiding portion provided for guiding a rear end of sheet so as to reduce noise generated by collision between the guiding portion and the rear end of the sheet.

According to the foregoing image forming apparatus, the sheet easily contacts the outer circumferential wall while passing through the curved conveyance path. Particularly at the time of double-sided printing, the temperature of the toner image fixed to a first surface of the sheet is raised high by heat generated from a fixing unit. In this case, the toner image may fuse and produce an abnormal image as a result of contact between the fused toner image and the outer circumferential wall. This problem becomes more conspicuous when the circumferential speed of the pair of discharge rollers is lower than the circumferential speed of a pair of fixing rollers, for example, in which condition the sheet easily bends in a loop shape.

In case of a structure which forms sheet feed ribs on the outer circumferential wall, these ribs may produce not only an abnormal image containing stripe marks in correspondence with the ribs, but also accumulation and congealment of fused toner on the ribs. When this accumulation occurs, the deposit of toner may scratch the image printed on the outer surface of the sheet. These scratches may produce an abnormal image containing white stripes as a result of exposure of the base of the sheet, or cause damage to the sheet. In recent years, the use of toner fusible at a low temperature is increasing in view of power consumption reduction or for other reasons. Accordingly, this damage is becoming more conspicuous than ever.

It is preferable that the sheet to be conveyed does not contact parts of the apparatus more than necessary in view of quality maintenance of the sheet, for example, in either case of single-sided printing or double-sided printing. Accordingly, such consideration is preferably given which minimizes the contact between the sheet and the outer circumferential wall while the sheet is passing through the curved conveyance path.

SUMMARY OF THE INVENTION

The present invention has been developed to solve the aforementioned problems. It is an object of the present invention to provide a sheet conveying device capable of minimizing contact between sheet and an outer circumferential wall while the sheet is passing through a curved conveyance path, and to provide an image forming apparatus including this sheet conveying device.

To achieve the abovementioned object, according to an aspect, a sheet conveying device reflecting one aspect of the present invention comprises: a curved conveyance path along which sheet is conveyed; and a pair of downstream side rollers that lies on the downstream side with respect to the curved conveyance path, and catches the sheet conveyed from the upstream side with respect to the curved conveyance path and reaching the curved conveyance path, wherein the curved conveyance path includes a movable guide movable between a first position and a second position, at the first position, the movable guide forms an outer circumferential wall of the curved conveyance path, and guides a tip of the sheet in such a direction that the sheet conveyed to the curved conveyance path travels toward the pair of downstream side rollers, and at the second position, a summit portion of a curve of the outer circumferential wall is retracted toward the outside in a radial direction of the curve with respect to the first position.

According to this configuration, contact between the outer circumferential wall and the sheet passing through the curved conveyance path is minimized. The "curved" state in this context refers to such a state that the traveling direction of the sheet changes to the thickness direction of the sheet as the sheet advances in the traveling direction.

In a more specific mode of the above configuration, the movable guide is preferably shifted from the first position to the second position when the tip of the sheet is caught between the pair of downstream side rollers. In a more specific mode of the above configuration, a pair of upstream side rollers are preferably provided on the upstream side with respect to the curved conveyance path. In this case, the sheet is conveyed to the curved conveyance path by the pair of the upstream side rollers.

In a more specific mode of the above configuration, the movable guide preferably includes an upstream side movable guide rotatable around a fulcrum located in the vicinity of the pair of upstream side rollers, and a downstream side movable guide rotatable around a fulcrum located in the vicinity of the pair of downstream side rollers. In this case, the shift from the first position to the second position is a shift of free ends of the upstream side movable guide and the downstream side movable guide toward the outside in the radial direction.

An image forming apparatus according to an embodiment of the present invention preferably comprises: a transfer unit that transfers a toner image to sheet; and the sheet conveying device having the above configuration, and conveying the sheet to the curved conveyance path after the toner image is transferred to the sheet, wherein the pair of upstream side rollers fix the toner image to the sheet, and the pair of downstream side rollers discharge the sheet.

In a more specific mode of the above configuration, the image forming apparatus preferably comprises a switchback path along which the sheet conveyed to the curved conveyance path returns to the transfer unit. In this case, the movable guide is movable to a third position at which the movable guide guides the sheet in such a direction that the sheet travels to the switchback path.

In a more specific mode of the above configuration, the image forming apparatus preferably executes a double-sided printing action for printing on both surfaces of sheet. In this case, the double-sided printing action includes: a first transfer process for transferring a toner image to one of surfaces of the sheet, the first transfer process executed by the transfer unit; a switchback process for returning the sheet to the transfer unit after the first transfer process, while positioning the movable guide at the third position; a second transfer process for transferring a toner image to the other surface of the returned sheet, the second transfer process executed by the transfer unit; and a discharge process for conveying the sheet to the pair of downstream side rollers after the second transfer process, while positioning the movable guide at the first position, and subsequently for shifting the movable guide to the second position when the tip of the sheet is caught between the pair of downstream side rollers.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, first through third embodiments of the present invention will be described with reference to the drawings, as specific examples of an embodiment of the present invention. However, the scope of the invention is not limited to the illustrated examples.

1. First Embodiment

General Configuration of Printer

A tandem digital color printer (an example of image forming apparatus, hereinafter abbreviated as "printer") according to the first embodiment is initially described as a specific example.

Figure 1:
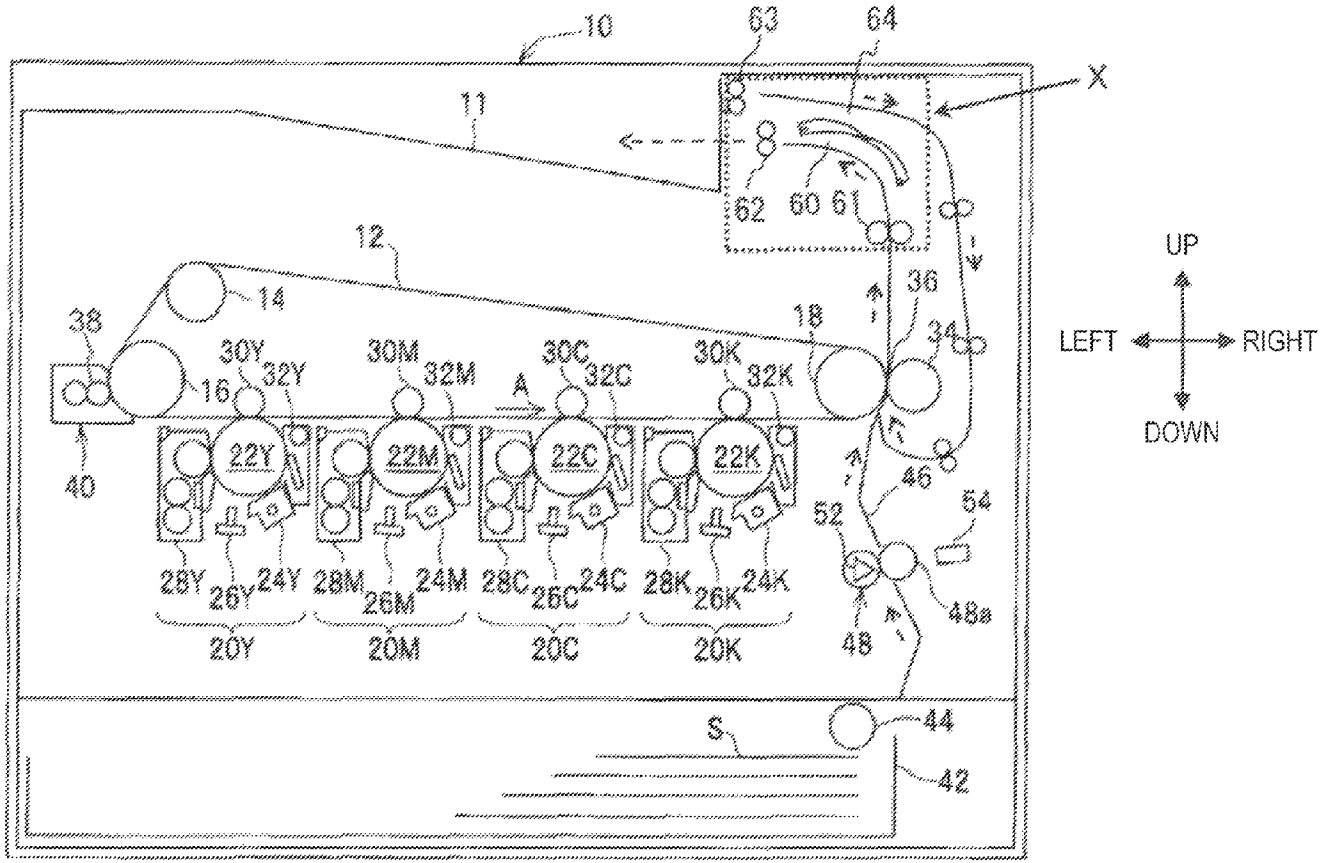
FIG. 1 illustrates a general configuration of a printer according to an embodiment.

FIG. 1 illustrates a general configuration of a printer 10 according to this embodiment. The up-down and left-right directions in the following description coincide with the up-down and left-right directions as viewed in FIG. 1. The printer 10 includes an intermediate transfer belt 12 located substantially at the center of the interior of the printer 10. The intermediate transfer belt 12 is made of semiconductive material, and supported by the outer circumferences of three rollers 14, 16, and 18. The intermediate transfer belt 12 is configured to rotate in a direction indicated by an arrow A.

Four imaging units 20Y, 20M, 20C, and 20K, corresponding to toner colors of yellow (Y), magenta (M), cyan (C), and black (K), respectively, are arranged along the intermediate transfer belt 12 below a lower horizontal portion of the intermediate transfer belt 12.

The imaging units 20Y, 20M, 20C, and 20K contain drum-shaped photosensitive bodies 22Y, 22M, 22C, and 22K, respectively. There are provided charging units 24Y, 24M, 24C, and 24K, print head units 26Y, 26M, 26C, and 26K, developing devices 28Y, 28M, 28C, and 28K, primary transfer rollers 30Y, 30M, 30C, and 30K, and cleaners 32Y, 32M, 32C, and 32K around the photosensitive bodies 22Y, 22M, 22C, and 22K, respectively, sequentially in this order in the rotation directions of the corresponding photosensitive bodies 22Y, 22M, 22C, and 22K.

The charging units 24Y, 24M, 24C, and 24K charge surfaces of the photosensitive bodies 22Y, 22M, 22C, and 22K. The print head units 26Y, 26M, 26C, and 26K expose the charged photosensitive body surfaces in accordance with respective color image data to form electrostatic latent images. The developing devices 28Y, 28M, 28C, and 28K develop the corresponding electrostatic latent images formed on the photosensitive body surfaces using toners in corresponding colors to form toner images.

The primary transfer rollers 30Y, 30M, 30C, and 30K are disposed at positions facing to the corresponding photosensitive bodies 22Y, 22M, 22C, and 22K, in such a state that the intermediate transfer belt 12 is interposed between the primary transfer rollers 30Y, 30M, 30C, and 30K and the photosensitive bodies 22Y, 22M, 22C, and 22K, and in such a state the inside of the intermediate transfer belt 12 contacts the primary transfer rollers 30Y, 30M, 30C, and 30K. The primary transfer rollers 30Y, 30M, 30C, and 30K transfer the toner images formed on the photosensitive body surfaces to the intermediate transfer belt 12 for primary transfer. The cleaners 32Y, 32M, 32C, and 32K collect toner remaining on the corresponding photosensitive body surfaces after primary transfer to clean the photosensitive body surfaces.

Each of the print head units 26Y, 26M, 26C, and 26K is constituted by a number of LEDs arranged in the horizontal scanning direction extending in parallel with the axial directions of the photosensitive bodies 22Y, 22M, 22C, and 22K.

A portion of the intermediate transfer belt 12 is supported by the roller 18. A secondary transfer roller 34 is pressed against the outside of this portion of the intermediate transfer belt 12.

The contact portion between the secondary transfer roller 34 and the intermediate transfer belt 12 forms a transfer area 36. The secondary transfer roller 34 is retractable to a position not contacting the intermediate transfer belt 12 by operation of a not-shown retracting mechanism.

Primary transfer voltage is applied from a not-shown power supply to the primary transfer rollers 30Y, 30M, 30C, and 30K. The toner images in respective colors are electrostatically attracted toward the surfaces of the photosensitive bodies 22Y, 22M, 22C, and 22K, and transferred to the intermediate transfer belt 12 for primary transfer by application of the primary transfer voltage.

On the other hand, secondary transfer voltage is applied from the not-shown power supply to the secondary transfer roller 34. The roller 18 supporting the intermediate transfer belt 12 is grounded. The toner images formed on the intermediate transfer belt 12 are electrostatically attracted toward a sheet S conveyed to the transfer area 36, and transferred to the sheet S for secondary transfer by application of the secondary transfer voltage.

A portion of the intermediate transfer belt 12 is supported by the roller 16. A cleaner 38 (cleaning brush roller) is pressed against this portion of the intermediate transfer belt 12. The cleaner 38 scrapes toner remaining on the intermediate transfer belt 12 after secondary transfer, and collects the scraped toner into a waste toner box 40. The cleaner 38 is retractable to a position not contacting the intermediate transfer belt 12 by operation of the not-shown retracting mechanism similarly to the secondary transfer roller 34.

A feed cassette 42 is detachably attached to a lower part of the printer 10. The sheets S are stacked and accommodated in the feed cassette 42. The sheet S located at the uppermost position in the feed cassette 42 is conveyed sheet by sheet to a conveyance path 46 in accordance with rotation of a feed roller 44. Dashed arrows in FIG. 1 indicate a traveling direction of the sheet S.

The conveyance path 46 extends from the feed cassette 42, through a nip portion of a pair of timing rollers 48, the secondary transfer area 36, a pair of fixing rollers 61, and a pair of discharge rollers 62, toward a discharge tray 11. The pair of timing rollers 48 are equipped to convey the sheet S coming from the feed cassette 42 in such a timing that the arrival of the sheet S at the transfer area 36 is synchronized with the arrival of the images thereat after the images are formed on the intermediate transfer belt 12.

A timing sensor 52 is provided in the vicinity of the pair of timing rollers 48. The timing sensor 52 is equipped to detect a state that the tip of the sheet S supplied from the feed cassette 42 to the conveyance path 46 has been nipped by the pair of timing rollers 48. When detecting the tip of the sheet S, the pair of timing rollers 48 temporarily stop rotation, and then conveys the sheet S to the transfer area 36 in synchronization with the toner images on the intermediate transfer belt 12.

A sheet thickness sensor 54 is disposed at a position facing to a roller 48*a* corresponding to one of the pair of timing rollers 48. The sheet thickness sensor 54 detects a shift quantity of the roller 48*a* produced when the sheet tip is nipped by the pair of timing rollers 48. The sheet thickness sensor 54 determines whether the sheet S is plain sheet, or sheet having a certain thickness, such as cardboard and an OHP sheet.

After the toner images are transferred to the sheet S at the transfer area 36, the sheet S is conveyed to the pair of fixing rollers 61 to fix the toner images to the sheet S. The pair of fixing rollers 61 use a fixing belt heated by a heater, for example, to fix the toner images to the sheet S.

A curved conveyance path 60 is formed between the pair of fixing rollers 61 and the pair of discharge rollers 62 to provide a path along which the sheet S is conveyed. At the time of single-sided printing, the sheet S supplied to the curved conveyance path 60 is conveyed by the pair of discharge rollers 62, and discharged to the discharge tray 11. A pair of switchback rollers 63, and a switchback path 64 are provided in the vicinity of the pair of discharge rollers 62. The sheet S supplied from the pair of switchback rollers 63 passes through the switchback path 64 to return to the transfer area 36.

At the time of double-sided printing, the pair of switchback rollers 63 convey the sheet S having one printing surface to the switchback path 64. The sheet S having one printing surface passes along the switchback path 64, and returns to the transfer area 36, where subsequent toner images are transferred to the other surface of the sheet S. After completion of transfer of the toner images to the other surface, the sheet S passes through the pair of fixing rollers 61, the curved conveyance path 60, and the pair of discharge rollers 62, and reaches the discharge tray 11 for discharge.

[General Operation of Printer]

Operation of the printer 10 having the foregoing configuration is hereinafter described. When an instruction of double-sided printing or single-sided printing is issued from an external device (such as a personal computer) to the printer 10, the printer 10 starts printing operation. At this time, image information is input to the printer 10. The printer 10 converts the input image information into digital image signals indicating colors of yellow, cyan, magenta, and black, and transmits the generated digital image signals to a print head LED drive circuit.

Based on the received digital signals, the drive circuit allows the respective print head units 26Y, 26M, 26C, and 26K to emit light for exposure. This exposure is performed such that a time difference is produced for each of the print head units 26Y, 26M, 26C, and 26K in this order. As a result, electrostatic latent images in corresponding colors are formed on the corresponding surfaces of the photosensitive bodies 22Y, 22M, 22C, and 22K.

The respective electrostatic latent images formed on the photosensitive bodies 22Y, 22M, 22C, and 22K are developed by the corresponding developing devices 28Y, 28M, 28C, and 28K to form toner images in respective colors. The toner images in respective colors are sequentially transferred to the intermediate transfer belt 12 moving in the direction of the arrow A for primary transfer in such positions as to overlap with each other, by the function of the primary transfer rollers 30Y, 30M, 30C, and 30K to which primary transfer voltage exhibiting positive polarity has been applied.

The respective toner images overlapped in this manner on the intermediate transfer belt 12 reach the transfer area 36 in accordance with the movement of the intermediate transfer belt 12. The overlapped toner images in respective colors are collectively transferred to the sheet S passing through the transfer area 36 for secondary transfer, by the function of the secondary transfer roller 34 to which the secondary transfer voltage exhibiting the same polarity as the polarity of the primary transfer voltage has been applied. The sheet S conveyed from the feed cassette 42 to the conveyance path 46 passes through the transfer area 36 in accordance with driving of the pair of timing rollers 48. Toner remaining on the intermediate transfer belt 12 after secondary transfer is collected by the function of the cleaner 38 to which cleaning current exhibiting positive polarity has been supplied. The collected toner shifts to a cleaning unit.

The sheet S to which the toner images have been transferred for secondary transfer passes through the conveyance path 46, and reaches the pair of fixing rollers 61. The toner images are thermally fixed to the sheet S while passing through the pair of fixing rollers 61. Thereafter, the sheet S is supplied to the curved conveyance path 60.

Operation for forming a color image is executed by the foregoing procedures. In forming a monochrome image, only the imaging unit 20K is operated to form a black toner image on the intermediate transfer belt 12 based on input monochrome image data. Thereafter, the black toner image is transferred to the sheet S in the transfer area 36 for secondary transfer, and thermally fixed by the pair of fixing rollers 61. The sheet S to which the black toner image has been transferred is conveyed to the curved conveyance path 60 in similar manners.

[Detailed Configuration Around Curved Conveyance Path]

Figure 2:
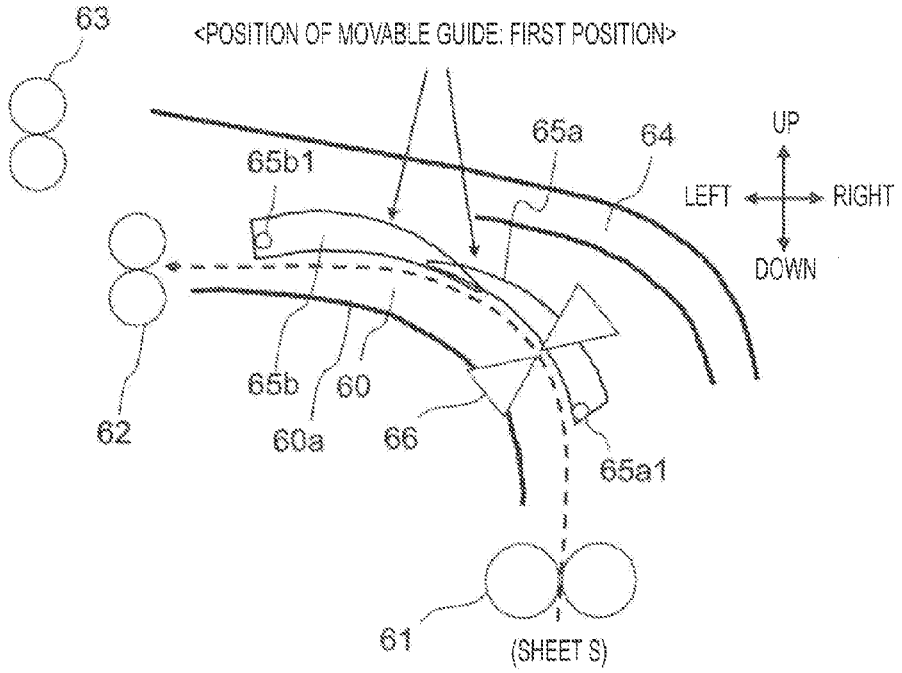
FIG. 2 illustrates a configuration around a curved conveyance path (a movable guide located at a first position) according to a first embodiment.

The detailed configuration around the curved conveyance path 60 is hereinafter described. FIG. 2 illustrates a configuration around the curved conveyance path 60 (portion indicated by X in FIG. 1). As illustrated in this figure, there are provided an upstream side movable guide 65*a*, a downstream side movable guide 65*b*, and a discharge sensor 66 around the curved conveyance path 60, in addition to the pair of fixing rollers 61, the pair of discharge rollers 62, the pair of switchback rollers 63, and the switchback path 64 mentioned above.

In the following description, the upstream side movable guide 65*a* and the downstream side movable guide 65*b* are collectively referred to as "movable guide 65" depending on the circumstances. As illustrated in FIG. 2, the curved conveyance path 60 is a conveyance path curved in the thickness direction of the sheet S to be conveyed, and constituted by an inner circumferential wall 60*a* (inner circumferential side wall), and the movable guide 65 corresponding to an outer circumferential wall (outer circumferential side wall). In the following description, the outer circumferential wall of the curved conveyance path 60 is abbreviated as "outer circumferential wall" depending on the circumstances.

The pair of fixing rollers 61 are disposed on the upstream side with respect to the curved conveyance path 60, while the pair of discharge rollers 62 are disposed on the downstream side with respect to the curved conveyance path 60. In the curved conveyance path 60, the sheet S is conveyed approximately in a direction indicated by a dashed arrow in FIG. 2. Terms "upstream side" and "downstream side" in this embodiment indicate the upstream side and the downstream side with respect to the flow of conveyance of the sheet S unless specified otherwise.

The curved conveyance path 60 is curved so that the upward direction of the path 60 changes approximately to the leftward direction as viewed from the upstream side to the downstream side. The curved conveyance path 60 changes the vertical direction of the sheet S conveyed from the pair of fixing rollers 61 to the horizontal direction so that the sheet S can be laid on the discharge tray 11 in an appropriate posture after discharge.

The movable guide 65 is movable between first through third positions. The movable guide 65 located at the first position (in the state illustrated in FIG. 2) forms the outer circumferential wall. In this case, the movable guide 65 guides the tip of the sheet S conveyed from the pair of fixing rollers 61 in such a direction that the sheet S can be conveyed toward the pair of discharge rollers 62 as indicated by a dashed arrow in FIG. 2.

The upstream side movable guide 65*a* located at the first position has a shape extended from a rotation fulcrum 65*a*1 disposed in the vicinity of the pair of fixing rollers 61 to form substantially a half (upstream side part) of the outer circumferential wall. Similarly, the downstream side movable guide 65*b* located at the first position has a shape extended from a rotation fulcrum 65*b*1 disposed in the vicinity of the pair of discharge rollers 62 to form substantially a half (downstream side part) of the outer circumferential wall.

A mechanism for shifting the movable guide 65 is hereinafter described. The upstream side movable guide 65*a* is movable around the rotation fulcrum 65*a*1. Similarly, the downstream side movable guide 65*b* is movable around the rotation fulcrum 65*b*1. Each of portions in the vicinity of free ends of the upstream side movable guide 65*a* and the downstream side movable guide 65*b* is comb-shaped, for example, so that the upstream side movable guide 65*a* and the downstream side movable guide 65*b* can cross each other in the form of a three-dimensional crossing.

Figure 3:
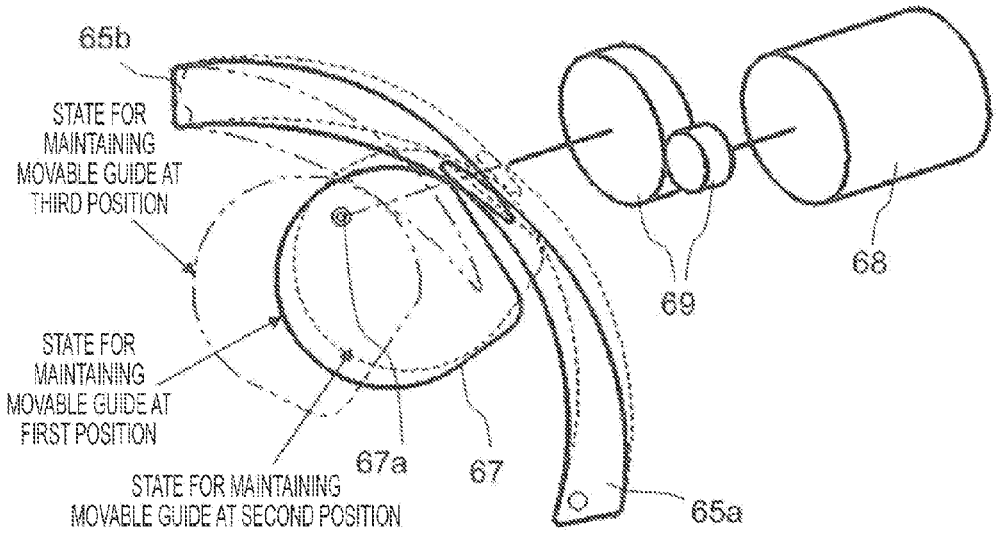
FIG. 3 illustrates a mechanism for shifting the movable guide according to the first embodiment.

As illustrated in FIG. 3, elements constituting a driving system for changing the position of the movable guide 65, such as a cam 67, a motor 68, and gears 69, are provided at predetermined positions in the vicinity of the movable guide 65 and not interfering with the conveyance of the sheet S (such as positions inside the feed area of the sheet S).

The cam 67 is rotatable around a rotation fulcrum 67*a* by a rotational force transmitted from the motor 68 to the cam 67 via the gears 69 to switch the state of the movable guide 65 between a state for maintaining the movable guide 65 at the first position, a state for maintaining the movable guide 65 at the second position, and a state for maintaining the movable guide 65 at the third position. When located at the first position or the second position, the upstream side movable guide 65*a* is so positioned as to contact a not-shown positioning member. On the other hand, the downstream side movable guide 65*b* is urged toward the cam 67.

Figure 4:
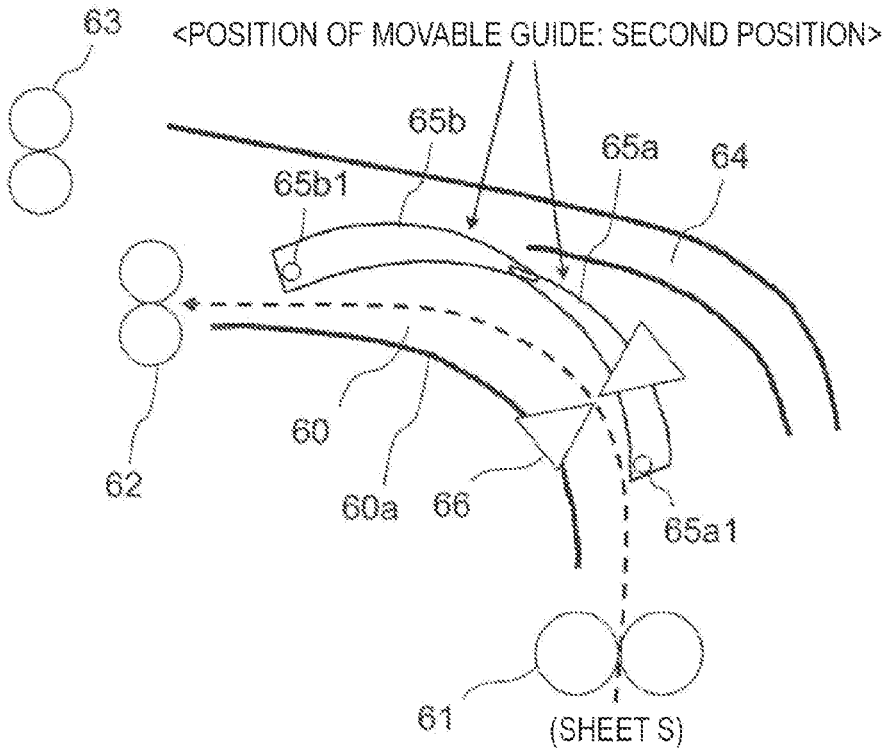
FIG. 4 illustrates a configuration around the curved conveyance path (the movable guide located at a second position) according to the first embodiment.

FIG. 4 illustrates the configuration around the curved conveyance path 60 when the movable guide 65 is located at the second position. The movable guide 65 shifts from the first position to the second position in accordance with movement of the free ends of the upstream side movable guide 65*a* and the downstream side movable guide 65*b* from the curved conveyance path 60 toward the outside in the radial direction for a shift in the retracting direction.

Figure 5:
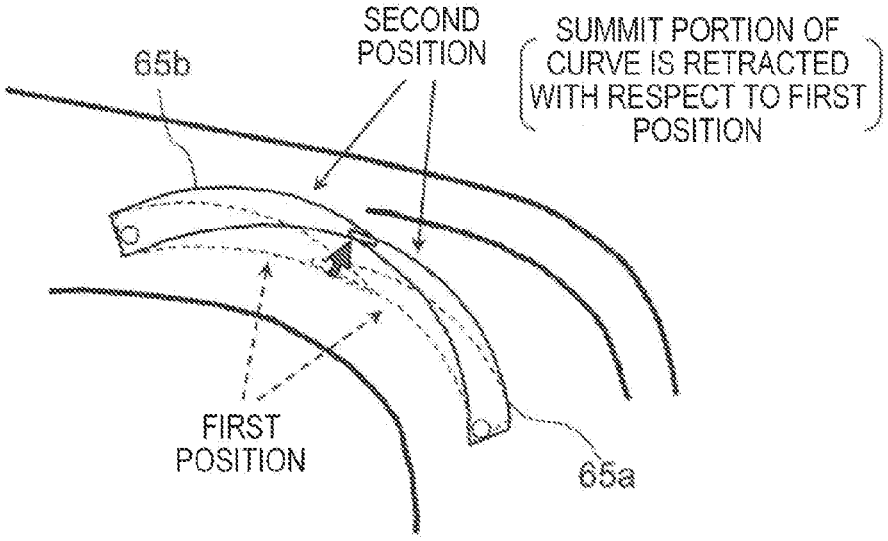
FIG. 5 illustrates retraction of a summit portion of a curve.

FIG. 5 illustrates comparison between the movable guide 65 at the first position (indicated by broken lines) and the movable guide 65 at the second position (indicated by solid lines). As illustrated in this figure, the movable guide 65 located at the second position is positioned such that a summit portion of a curve of the outer circumferential wall (corresponding to a central portion of the curved area, i.e., portions of the upstream side movable guide 65*a* and the downstream side movable guide 65*b* at positions closest to each other according to this embodiment) is retracted by a length indicated by a colored arrow in comparison with the first position.

Figure 6:
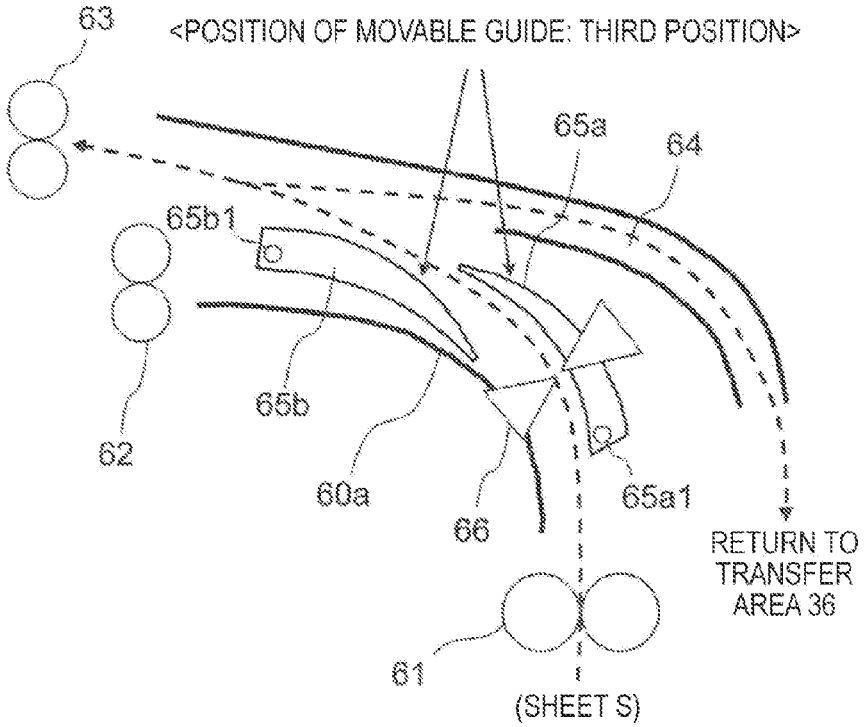
FIG. 6 illustrates a configuration around the curved conveyance path (the movable guide located at a third position) according to the first embodiment.

FIG. 6 illustrates the configuration around the curved conveyance path 60 when the movable guide 65 is located at the third position. When the movable guide 65 is located at the third position, the free end of the downstream side movable guide 65*b* comes close to the inner circumferential wall 60*a* of the curved conveyance path 60. Accordingly, as indicated by a dashed arrow in FIG. 6, the sheet S conveyed from the pair of fixing rollers 61 to the curved conveyance path 60 passes between the upstream side movable guide 65*a* and the downstream side movable guide 65*b*, and reaches the pair of switchback rollers 63. Then, the sheet S is conveyed to the switchback path 64 by the pair of switchback rollers 63 to return to the transfer area 36.

The discharge sensor 66 is disposed at a predetermined position on the upstream side in the curved conveyance path 60 to detect the sheet S passing through the position of the discharge sensor 66. The printer 10 recognizes the time when the tip of the sheet S passes through the position of the discharge sensor 66 based on a detection result obtained from the discharge sensor 66.

[Position Control of Movable Guide]

Figure 7:
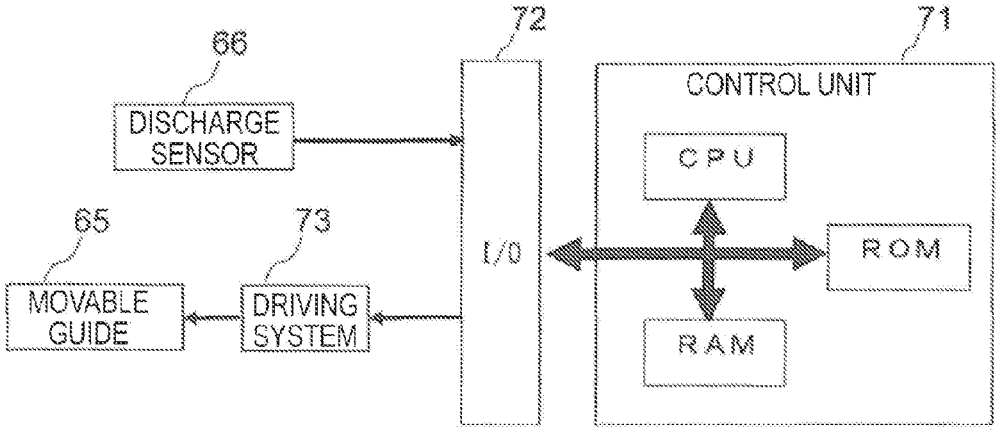
FIG. 7 is a block diagram illustrating a system associated with position control of the movable guide.

FIG. 7 is a block diagram illustrating a system associated with position control of the movable guide 65. As illustrated in this figure, the printer 10 includes a control unit 71 controlling the position of the movable guide 65, an I/O (input/output) unit 72 associated with input and output of information, and a driving system 73 associated with driving of the movable guide 65.

The control unit 71 including a CPU, a ROM, and a RAM transmits instruction signals to the driving system 73 via the I/O unit 72 to appropriately control the position of the movable guide 65. The driving system 73 includes the cam 67, the motor 68, and the gears 69 noted above, and further includes a driving circuit for driving the motor 68 in accordance with instructions issued from the control unit 71, for example. The control unit 71 obtains information on detection results from the discharge sensor 66 via the I/O unit 72.

Figure 8:
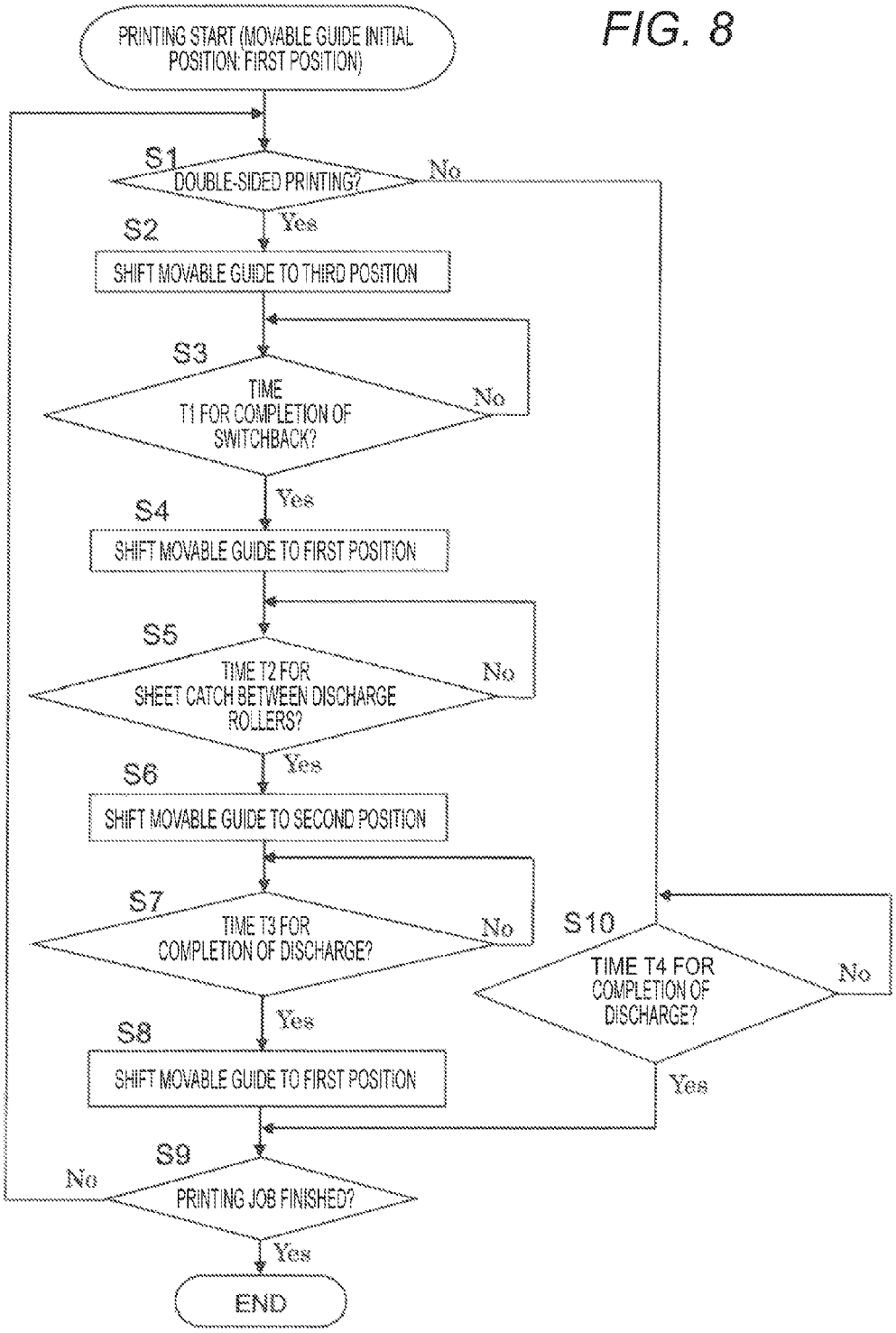
FIG. 8 is a flowchart describing the position control of the movable guide.

The details of the position control of the movable guide 65 performed at the time of printing are hereinafter described with reference to a flowchart shown in FIG. 8. It is assumed in this embodiment that the movable guide 65 is maintained at the first position in the normal condition.

When receiving an instruction of printing, the control unit 71 determines whether the instruction is double-sided printing, or single-sided printing (step S1). When the instruction is the double-sided printing (step S1: YES), the control unit 71 shifts the movable guide 65 to the third position (step S2).

As a result, the movable guide 65 comes into a posture illustrated in FIG. 6. The control unit 71 maintains this posture of the movable guide 65 until a time T1 when switchback of the sheet S is completed (step S3).

By the time T1, the following processes are completed: (1) toner images are transferred to one of the surfaces of the sheet S in the transfer area 36; (2) the toner images are fixed to the sheet S by the pair of fixing rollers 61; (3) the sheet S passes between the upstream side movable guide 65*a* and the downstream side movable guide 65*b* to reach the pair of switchback rollers 63; and (4) the sheet S is returned by the pair of switchback rollers 63.

At the time T1 (step S3: YES), the control unit 71 shifts the movable guide 65 to the first position (step S4). As a result, the movable guide 65 comes into a posture illustrated in FIG. 2. The control unit 71 maintains this posture of the movable guide 65 until a time T2 when the sheet S is caught between the pair of discharge rollers 62 (step S5).

By the time T2, the following processes are completed: (5) toner images are transferred to the other surface of the sheet S in the transfer area 36; (6) the toner images are fixed to the sheet S by the pair of fixing rollers 61; and (7) the tip of the sheet S passes through the curved conveyance path 60 and reaches the pair of discharge rollers 62.

At the time T2 (step S5: YES), the control unit 71 shifts the movable guide 65 to the second position (step S6). As a result, the movable guide 65 comes into a position illustrated in FIG. 4. The control unit 71 maintains this posture of the movable guide 65 until a time T3 when discharge of the sheet S is completed (step S7).

By the time T3, the following process is completed: (8) the sheet S is conveyed toward the discharge tray 11 by the function of the pair of discharge rollers 62. During this period, the movable guide 65 located at the second position is retracted toward the outside in the radial direction in comparison with the first position. Accordingly, contact between the sheet S and the movable guide 65 is minimized.

At the time T3 (step S7: YES), the control unit 71 shifts the movable guide 65 to the first position (step S8). As a result, the movable guide 65 comes to the normal position. Then, the control unit 71 determines whether or not the printing job has been finished (step S9). When the printing job is not finished (step S9: NO), the control unit 71 returns to step S1 and repeats the process in step S1. When the printing job is finished (step S9: YES), the control unit 71 ends this printing.

When receiving an instruction of single-sided printing (step S1: NO), the control unit 71 waits until a time T4 when discharge of the sheet S is completed (step S10). At the time T4 (step S10: YES), the control unit 71 executes the process in step S9.

In case of single-sided printing, toner images are transferred only to one of the surfaces of the sheet S (surface not facing to the movable guide 65), wherefore substantially no contact is made between the toner images and the movable guide 65. Accordingly, as noted above, no serious problem occurs when the process for shifting the movable guide 65 from the first position to the second position (process corresponding to step S6) is omitted. It is preferable, however, that contact between the sheet S and the movable guide 65 is minimized at the time of discharge of the sheet S by the function of the pair of discharge rollers 62. From this point of view, the process for shifting the movable guide 65 from the first position to the second position may be executed even in case of single-sided printing.

The control unit 71 recognizes the times T1 through T4 based on detection results obtained from the discharge sensor 66. More specifically, the periods until the respective times T1 through T4 from the time when the tip of the sheet S is detected by the discharge sensor 66 are known beforehand based on specifications or the like of the printer 10. The control unit 71 retains information on these periods, and therefore recognizes the respective times T1 through T4 based on this information and the detection results obtained from the discharge sensor 66. Accordingly, the control unit 71 can execute the foregoing processes in steps S3, S5, S7, and S10 in appropriate manners.

As noted above, the printer 10 performs a double-sided printing action for printing on both surfaces of the sheet S. This double-sided printing action includes processes such as (A) a first transfer process for transferring toner images to one of the surfaces of the sheet S in the transfer area 36, (B) a switchback process for returning the sheet S to the transfer area 36 after the first transfer process, while positioning the movable guide 65 at the third position, (C) a second transfer process for transferring toner images to the other surface of the returned sheet S in the transfer area 36, and (D) a discharge process for conveying the sheet S to the pair of discharge rollers 62 after the second transfer process, while positioning the movable guide 65 at the first position, and subsequently for shifting the movable guide 65 to the second position when the tip of the sheet S is caught between the pair of discharge rollers 62.

The movable guide 65 constitutes the outer circumferential wall. When the movable guide 65 is located at the second position, the summit portion of the curve is retracted toward the outside in the radial direction in comparison with the first position. The movable guide characterized in this point is not limited to the specific example of the movable guide in this embodiment, but may be other types of movable guides. Movable guides according to second and third embodiments discussed hereinbelow are examples of types different from the movable guide according to the first embodiment.

2. Second Embodiment

The second embodiment is hereinafter described. In the following description, only points different from the corresponding points in the first embodiment are chiefly discussed, and explanation of points common to both the embodiments is not repeated.

Figure 9:
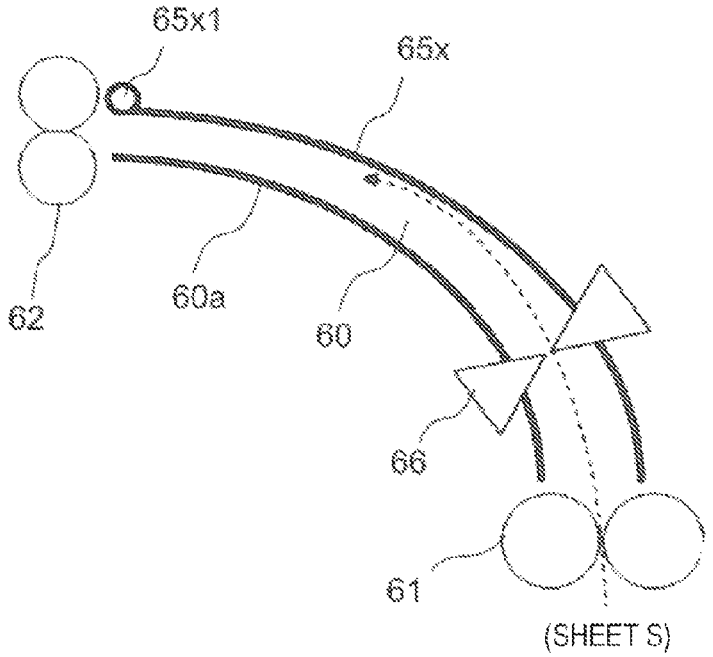
FIG. 9 illustrates a configuration around a curved conveyance path according to a second embodiment.

FIG. 9 illustrates a configuration around the curved conveyance path 60 according to this embodiment. A movable guide 65*x* illustrated in this figure has a shape different from the shape of the movable guide 65 according to the first embodiment. This embodiment is applicable to a structure not including the switchback mechanism for the sheet S (such as a structure performing only single-sided printing), or to a structure which positions the switchback mechanism for the sheet S at a location not shown in the figure.

The movable guide 65*x* is rotatable around a rotation fulcrum 65*x*1 disposed in the vicinity of the pair of discharge rollers 62, and forms the outer circumferential wall of the curved conveyance path 60 when lying in a state at the first position (state illustrated in FIG. 9). The movable guide 65*x* in this state guides the tip of the sheet S conveyed from the pair of fixing rollers 61 in such a direction that the sheet S travels toward the pair of discharge rollers 62.

Figure 10:
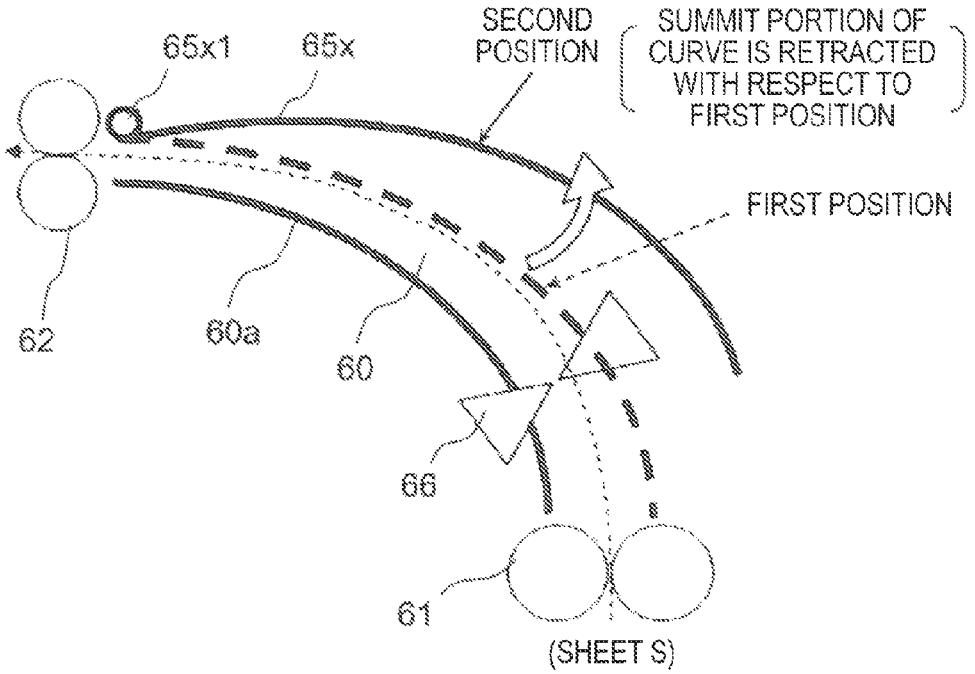
FIG. 10 illustrates a shift of movable guide according to the second embodiment.

FIG. 10 illustrates the movable guide 65*x* shifted from the first position to the second position. As illustrated in this figure, the movable guide 65*x* at the first position rotates around the rotation fulcrum 65*x*1 in a direction indicated by a white arrow to shift to the second position. When the movable guide 65*x* is located at the second position, the summit portion of the curve of the outer circumferential wall is retracted toward the outside in the radial direction in comparison with the first position.

Accordingly, similarly to the first embodiment, contact between the sheet S and the movable guide 65*x* is minimized by the shift of the movable guide 65*x* from the first position to the second position when the sheet S is caught between the pair of discharge rollers 62.

Figure 11:
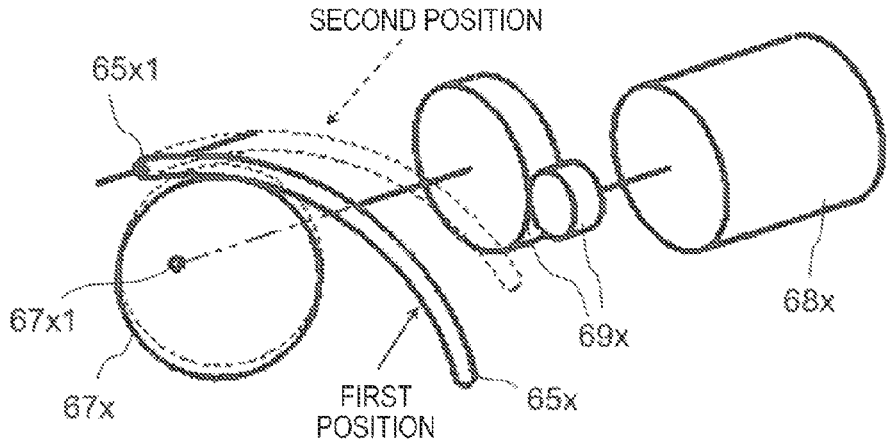
FIG. 11 illustrates a mechanism for shifting the movable guide according to the second embodiment.

FIG. 11 illustrates a mechanism for shifting the movable guide 65*x*. As illustrated in this figure, a cam 67*x*, a motor 68*x*, and gears 69*x* are provided to constitute a driving system for shifting the position of the movable guide 65*x*. This driving system is located at a position not interfering with conveyance of the sheet S.

The cam 67*x* is rotated around a rotation fulcrum 67*x*1 by a rotational force transmitted from the motor 68*x* to the cam 67*x* via the gears 69*x* to switch the state of the movable guide 65*x* between a state for maintaining the movable guide 65*x* at the first position, and a state for maintaining the movable guide 65*x* at the second position. According to this embodiment, the position of the movable guide 65*x* is controllable by control of the driving of the motor 68*x*.

3. Third Embodiment

The third embodiment is hereinafter described. In the following description, only points different from the corresponding points in the first embodiment are chiefly discussed, and explanation of points common to both the embodiments is not repeated.

Figure 12:
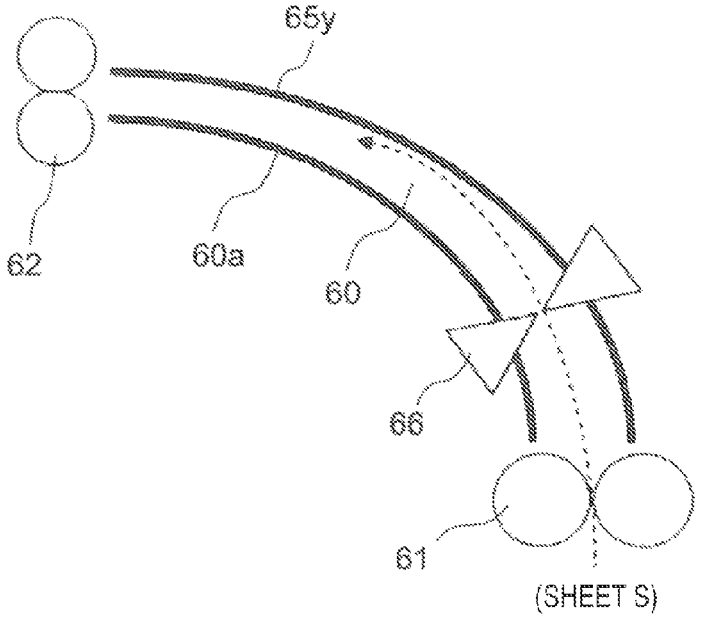
FIG. 12 illustrates a configuration around a curved conveyance path according to a third embodiment.

FIG. 12 illustrates a configuration around the curved conveyance path 60 according to this embodiment. A movable guide 65*y* illustrated in this figure has a shape different from the shape of the movable guide 65 according to the first embodiment. This embodiment is applicable to a structure not including the switchback mechanism for the sheet S (such as a structure performing only single-sided printing), or to a structure which positions the switchback mechanism for the sheet S at a location not shown in the figure.

The movable guide 65*y* lying in a state at the first position (state illustrated in FIG. 12) forms the outer circumferential wall of the curved conveyance path 60. The movable guide 65*y* in this state guides the tip of the sheet S conveyed from the pair of fixing rollers 61 in such a direction that the sheet S travels toward the pair of discharge rollers 62.

Figure 13:
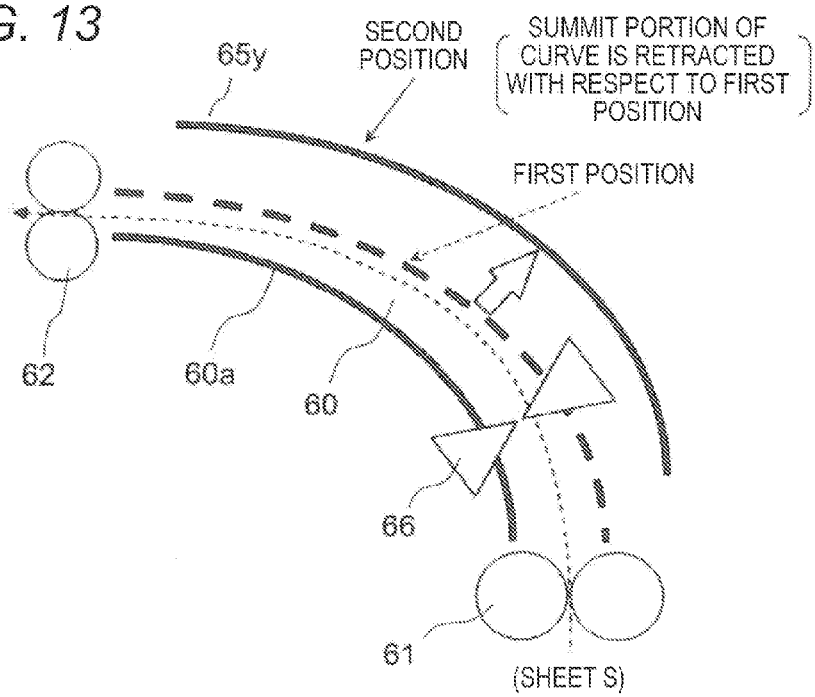
FIG. 13 illustrates a shift of movable guide according to the third embodiment.

FIG. 13 illustrates the movable guide 65*y* shifted from the first position to the second position. As illustrated in this figure, the movable guide 65*y* at the first position shifts to the second position by parallel movement in a direction indicated by a white arrow. When the movable guide 65*y* is located at the second position, the summit portion of the curve of the outer circumferential wall is retracted toward the outside in the radial direction in comparison with the first position.

Accordingly, similarly to the first embodiment, contact between the sheet S and the movable guide 65*y* is minimized by the shift of the movable guide 65*y* from the first position to the second position when the sheet S is caught between the pair of discharge rollers 62.

Figure 14:
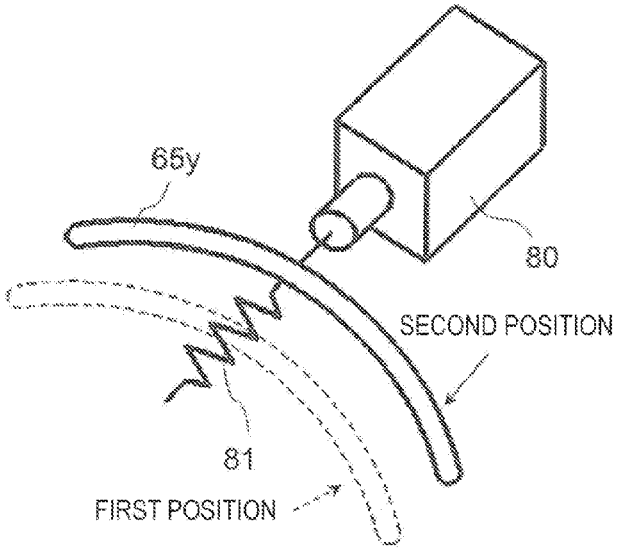
FIG. 14 illustrates a mechanism for shifting the movable guide according to the third embodiment.

FIG. 14 illustrates a mechanism for shifting the movable guide 65*y*. As illustrated in this figure, a solenoid 80 and a spring 81 are provided to constitute a driving system for changing the position of the movable guide 65*y*. This driving system is located at a position not interfering with conveyance of the sheet S.

In the normal condition, the movable guide 65*y* is maintained at the first position by an elastic force of the spring 81. When the solenoid 80 is actuated, the movable guide 65*y* is shifted to the second position by a magnetic force generated from the solenoid 80. According to this embodiment, the position of the movable guide 65*y* is controllable by control of the driving of the solenoid 80.

4. Others

The printer 10 according to each of the foregoing embodiments includes the sheet conveying device which contains the curved conveyance path 60 along which the sheet S is conveyed, and the pair of discharge rollers 62 disposed downstream with respect to the curved conveyance path 60. This sheet conveying device is a device which uses the pair of discharge rollers 62 for catching the sheet S conveyed from the pair of fixing rollers 61 and the subsequent curved conveyance path 60 disposed on the upstream side, and includes the movable guide movable between the first position and the second position.

At the first position, the movable guide forms the outer circumferential wall of the curved conveyance path 60, and guides the tip of the sheet S supplied to the curved conveyance path 60 in such a direction that the sheet S travels toward the pair of discharge rollers 62. At the second position, the summit portion of the curve of the outer circumferential wall is retracted to the outside in the radial direction in comparison with the first position. According to the sheet conveying device characterized in this point, contact between the outer circumferential wall and the sheet S passing through the curved conveyance path 60 can be minimized.

While the specific embodiments according to the present invention have been described herein, the subject matters of the present invention are not limited to these examples. Various modifications and changes may be made to the foregoing embodiments without departing from the scope of the present invention.

The present invention is applicable to an image forming apparatus which conveys sheet, for example.

According to an embodiment of the present invention, a sheet conveying device minimizes contact between sheet and an outer circumferential wall while the sheet is passing through a curved conveyance path. In addition, an image forming apparatus according to an embodiment of the present invention offers advantages similar to the advantages of the sheet conveying device according to an embodiment of the present invention.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A sheet conveying device for receiving a sheet from a transfer unit of an image forming apparatus, comprising:

a curved conveyance path along which the sheet is conveyed, wherein the curved conveyance path is disposed on a downstream side of the transfer unit;

a pair of downstream side rollers that lies on a downstream side with respect to the curved conveyance path, and catches the sheet conveyed from an upstream side with respect to the curved conveyance path and reaching the curved conveyance path, wherein the curved conveyance path includes a movable guide movable between a first position and a second position, at the first position, the movable guide forms an outer circumferential wall of the curved conveyance path, and guides a tip of the sheet in such a direction that the sheet conveyed to the curved conveyance path travels toward the pair of downstream side rollers, and at the second position, a summit portion of a curve of the outer circumferential wall is retracted toward the outside in a radial direction of the curve with respect to the first position;

a driving unit moving the movable guide to the first position and the second position; and a controlling unit controlling the driving unit and configured to controllably move the movable guide to the first position and the second position, the controlling unit controlling the driving unit to arrange the movable guide at the first position until a distal end of the sheet reaches the pair of downstream side rollers via the curved conveyance path and to shift the movable guide to the second position when the distal end of the sheet reaches the pair of downstream side rollers.

2. The sheet conveying device according to claim 1, wherein the movable guide is shifted from the first position to the second position when the distal end of the sheet is caught between the pair of downstream side rollers.

3. The sheet conveying device according to claim 1, further comprising:

a pair of upstream side rollers provided on the upstream side with respect to the curved conveyance path, wherein the sheet is conveyed to the curved conveyance path by the pair of the upstream side rollers.

4. An image forming apparatus comprising:

the transfer unit that transfers a toner image to sheet; and the sheet conveying device according to claim 1, the sheet being conveyed to the curved conveyance path of the sheet conveying device after the toner image is transferred to the sheet.

5. A sheet conveying device comprising:

a curved conveyance path along which sheet is conveyed;

a pair of downstream side rollers that lies on the downstream side with respect to the curved conveyance path, and catches the sheet conveyed from the upstream side with respect to the curved conveyance path and reaching the curved conveyance path; and a pair of upstream side rollers provided on the upstream side with respect to the curved conveyance path, wherein the sheet is conveyed to the curved conveyance path by the pair of the upstream side rollers, wherein the curved conveyance path includes a movable guide movable between a first position and a second position, at the first position, the movable guide forms an outer circumferential wall of the curved conveyance path, and guides a tip of the sheet in such a direction that the sheet conveyed to the curved conveyance path travels toward the pair of downstream side rollers, at the second position, a summit portion of a curve of the outer circumferential wall is retracted toward the outside in a radial direction of the curve with respect to the first position, the movable guide includes an upstream side movable guide rotatable around a fulcrum located in the vicinity of the pair of upstream side rollers, and a downstream side movable guide rotatable around a fulcrum located in the vicinity of the pair of downstream side rollers, and the shift from the first position to the second position is a shift of free ends of the upstream side movable guide and the downstream side movable guide toward the outside in the radial direction.

6. An image forming apparatus comprising:

a transfer unit that transfers a toner image to sheet; and a sheet conveying device comprising:

a curved conveyance path along which the sheet is conveyed after the toner image is transferred to the sheet;

a pair of downstream side rollers that lies on a downstream side with respect to the curved conveyance path, and catches the sheet conveyed from an upstream side with respect to the curved conveyance path and reaching the curved conveyance path, wherein the curved conveyance path includes a movable guide movable between a first position and a second position, at the first position, the movable guide forms an outer circumferential wall of the curved conveyance path, and guides a tip of the sheet in such a direction that the sheet conveyed to the curved conveyance path travels toward the pair of downstream side rollers, and at the second position, a summit portion of a curve of the outer circumferential wall is retracted toward the outside in a redial direction of the curved with respect to the first position;

a driving unit moving the movable guide to the first position and the second position;

a controlling unit controlling the driving unit and configured to controllably move the movable guide to the first position and the second position, the controlling unit controlling the driving unit to arrange the movable guide at the first position until a distal end of the sheet reaches the pair of downstream side rollers via the curved conveyance path and to shift the movable guide to the second position when the distal end of the sheet reaches the pair of downstream side rollers; and a pair of upstream side rollers provided on the upstream side with respect to the curved conveyance path, wherein the sheet is conveyed to the curved conveyance path by the pair of the upstream side rollers, wherein the pair of upstream side rollers fix the toner image to the sheet, and the pair of downstream side rollers discharge the sheet.

7. The image forming apparatus according to claim 6, further comprising:

a switchback path along which the sheet conveyed to the curved conveyance path returns to the transfer unit, wherein the movable guide is movable to a third position at which the movable guide guides the sheet in such a direction that the sheet travels to the switchback path.

8. The image forming apparatus according to claim 7, wherein the image forming apparatus executes a double-sided printing action for printing on both surfaces of sheet, and the double-sided printing action includes a first transfer process for transferring a toner image to one of surfaces of the sheet, the first transfer process executed by the transfer unit, a switchback process for returning the sheet to the transfer unit after the first transfer process, while positioning the movable guide at the third position, a second transfer process for transferring a toner image to the other surface of the returned sheet, the second transfer process executed by the transfer unit, and a discharge process for conveying the sheet to the pair of downstream side rollers after the second transfer process, while positioning the movable guide at the first position, and subsequently for shifting the movable guide to the second position when the tip of the sheet is caught between the pair of downstream side rollers.

9. A sheet conveying device in combination with an image forming apparatus including a transfer unit that transfers an image to a sheet, the sheet conveying device comprising:

a curved conveyance path along which the sheet is conveyed;

a pair of downstream side rollers that lies on a downstream side with respect to the curved conveyance path, and catches the sheet conveyed from an upstream side with respect to the curved conveyance path and reaching the curved conveyance path, wherein the curved conveyance path includes a movable guide movable between a first position and a second position, at the first position, the movable guide forms an outer circumferential wall of the curved conveyance path, and guides a tip of the sheet in such a direction that the sheet conveyed to the curved conveyance path travels toward the pair of downstream side rollers, and at the second position, a summit portion of a curve of the outer circumferential wall is retracted toward the outside in a radial direction of the curve with respect to the first position;

a driving unit moving the movable guide to the first position and the second position; and a controlling unit controlling the driving unit to arrange the movable guide at the first position until a distal end of the sheet reaches the pair of downstream side rollers via the curved conveyance path and to shift the movable guide to the second position when the distal end of the sheet reaches the pair of downstream side rollers, wherein the sheet conveying device is arranged downstream of the transfer unit such that the sheet passes through the curved conveyance path after the image has been transferred to the sheet in the transfer unit, the image forming apparatus being capable of a one-sided printing and a two-sided printing of the sheet, and the controlling unit controlling the driving unit so that the movable guide is held at the first position during the one-sided printing and so that the movable guide is moved between the first position and the second position during the two-sided printing.

10. A sheet conveying device comprising a curved conveyance path along which the sheet is conveyed, wherein the curved conveyance path is disposed on a downstream side of a transfer unit;

a pair of downstream side rollers that lies on a downstream side with respect to the curved conveyance path, and catches the sheet conveyed from an upstream side with respect to the curved conveyance path and reaching the curved conveyance path, wherein the curved conveyance path includes a movable guide movable between a first position and a second position, at the first position, the movable guide forms an outer circumferential wall of the curved conveyance path, and guides a tip of the sheet in such a direction that the sheet conveyed to the curved conveyance path travels toward the pair of downstream side rollers, and at the second position, a summit portion of a curve of the outer circumferential wall is retracted toward the outside in a radial direction of the curved with respect to the first position;

a driving unit moving the movable guide to the first position and the second position;

a controlling unit controlling the driving unit and configured to controllably move the movable guide to the first position and the second position, the controlling unit controlling the driving unit to arrange the movable guide at the first position until a distal end of the sheet reaches the pair of downstream side rollers via the curved conveyance path and to shift the movable guide to the second position when the distal end of the sheet reaches the pair of downstream side rollers; and a discharge sensor disposed in an area of the movable guide.

* * * * *